US012310461B2

(12) United States Patent
Morris et al.

(10) Patent No.: US 12,310,461 B2
(45) Date of Patent: May 27, 2025

(54) WEB STRAP BUCKLE WITH LOCKING MECHANISM

(71) Applicant: Buckles International, Inc., Meriden, CT (US)

(72) Inventors: John L. Morris, Meriden, CT (US); David Kaiser, Meriden, CT (US)

(73) Assignee: BUCKLES INTERNATIONAL, INC., Meriden, CT (US)

( * ) Notice: Subject to any disclaimer, the term of this patent is extended or adjusted under 35 U.S.C. 154(b) by 0 days.

(21) Appl. No.: 18/221,080

(22) Filed: Jul. 12, 2023

(65) Prior Publication Data

US 2025/0017324 A1 Jan. 16, 2025

(51) Int. Cl.
*A44B 11/10* (2006.01)

(52) U.S. Cl.
CPC ..... *A44B 11/10* (2013.01)

(58) Field of Classification Search
CPC ... A44B 11/10; A44B 11/2557; A44B 11/006; A44B 11/04; Y10T 24/4019; Y10T 24/4084; Y10T 24/4047; Y10T 24/4086; Y10T 24/4736
See application file for complete search history.

(56) References Cited

U.S. PATENT DOCUMENTS 303,360 A * 8/1884 Brunner ..... A43C 7/00 24/712.7
323,084 A * 7/1885 Stratton ..... A44B 11/04 54/56
1,234,818 A * 7/1917 Sturrock ..... A44B 11/10 24/196
1,374,691 A * 4/1921 Troop ..... A44B 11/10 24/196
3,486,203 A * 12/1969 Cadiou ..... A44B 11/2557 D11/216
3,866,272 A * 2/1975 Prete, Jr. ..... B65D 63/16 24/68 CD
3,879,810 A * 4/1975 Prete, Jr. ..... A44B 11/16 24/313
4,131,976 A * 1/1979 Bengtsson ..... A44B 11/10 24/196
4,389,756 A * 6/1983 Kasama ..... A44B 11/10 24/171
5,471,714 A * 12/1995 Olson ..... A44B 11/10 24/171

(Continued)

FOREIGN PATENT DOCUMENTS

DE 9311675 U1 * 9/1993
EP 3744199 A1 * 12/2020 ..... A41D 3/00

(Continued)

*Primary Examiner* — Jason W San
*Assistant Examiner* — Anna S Rashid
(74) *Attorney, Agent, or Firm* — Dilworth IP, LLC

(57) ABSTRACT

A buckle including a housing with a cavity having a proximal end and distal end, a first sidewall extending at least partially between the proximal end and the distal end, and a second sidewall, opposite the first sidewall, extending at least partially between the proximal end and the distal end, a detent on at least one of the first sidewall or the second sidewall, and a slide lock positioned in the cavity and slidable between an unlocked position on a proximal side of the detent and a locked position on a distal side of the detent.

20 Claims, 9 Drawing Sheets

(56) References Cited

U.S. PATENT DOCUMENTS

| | | | | |
|---|---|---|---|---|
| 7,004,695 | B1 * | 2/2006 | Wen-Hsiang | B60P 7/0823 410/23 |
| 7,631,401 | B2 * | 12/2009 | Chen | A44B 11/10 24/194 |
| 8,668,696 | B2 * | 3/2014 | Foerster | A61B 17/0401 24/171 |
| 8,715,297 | B1 * | 5/2014 | Foerster | A61B 17/823 606/139 |
| 9,017,330 | B2 * | 4/2015 | Foerster | A61B 17/82 24/171 |
| 9,993,669 | B2 * | 6/2018 | Casebolt | A62B 35/0037 |
| 10,897,963 | B2 * | 1/2021 | Geist | B60N 2/2816 |
| 11,246,379 | B2 * | 2/2022 | Bradley | A44B 11/06 |
| 11,553,764 | B2 * | 1/2023 | Evans | A44B 11/06 |
| D1,014,327 | S * | 2/2024 | Robinson | D11/218 |
| 12,042,024 | B2 * | 7/2024 | Hörtnagl | A42B 3/08 |
| 2014/0018828 | A1 * | 1/2014 | Foerster | A61B 17/823 606/151 |
| 2019/0269206 | A1 * | 9/2019 | Kolasa | A44B 11/12 |
| 2019/0380451 | A1 * | 12/2019 | Geist | A44B 11/065 |
| 2019/0387844 | A1 * | 12/2019 | Millward | F16B 2/18 |
| 2020/0163418 | A1 * | 5/2020 | Morgan | A44B 11/125 |
| 2022/0256980 | A1 * | 8/2022 | Hörtnagl | A42B 3/08 |

FOREIGN PATENT DOCUMENTS

| | | | | |
|---|---|---|---|---|
| GB | 2127090 | A * | 4/1984 | A44B 11/263 |
| GB | 2262304 | A * | 6/1993 | A44B 11/125 |
| GB | 2262304 | B | 6/1993 | |

* cited by examiner

DETAIL A

WEB STRAP BUCKLE WITH LOCKING MECHANISM

FIELD OF THE INVENTION

The present disclosure relates buckle for securing web straps, and more particularly, to a web strap buckle with a locking mechanism.

BACKGROUND

Web strap buckles or webbing buckles are well known and used in many different applications. A typical web strap buckle includes a housing with cross-member. A web strap is fed through the housing and around the cross-member to secure the web strap in tension.

Web strap buckles are generally effective at holding web straps while the web strap is in tension. However, when tension is reduced, even intermittently, the web strap buckle can loosen or release. For example, web straps are often used to secure outdoor tents. As wind acts the tent, tension in the straps changes and the buckles are susceptible to loosening.

U.S. Pat. No. 11,553,764 discloses a belt buckle with a displaceable central bar. The central bar is locked to prevent rotation but is free to move laterally in the buckle. Therefore, the belt can loosen when it is not in tension. U.S. Pat. No. 8,668,696 discloses a buckle with a bar that slides in a slot. The bar can be retained during the initial tensioning but is able to slide as it would in a normal buckle after tensioning.

Some buckles include features to restrain the web strap but can be difficult to operate and generally require a more complicated design that can be subject to failure. For example, U.S. Pat. No. 3,486,203 discloses a device for adjusting the length of a safety belt for vehicles. The buckle includes a tightening pin that is movable by a flat spring. The pin can be pushed toward a rod causing the strap to be double wedged.

U.S. Pat. No. 5,471,714 discloses a device for adjustable attachment of a strap including an aperture with a cross bar and a moveable plate biased by a spring. A strap is passed through an opening in the plate and around the cross bar. The spring bias of the spring clamps the strap against the cross bar at a lower end of the opening.

UK Patent No. GB2262304B describes a tensioning buckle aimed at addressing the problem of slackening tension. The buckle includes a V-shaped spring that applies pressure on the strap threaded through the frame of the buckle to prevent slippage.

It is desired to have a buckle that avoids the problems in the prior art with a simple, easy to use, and reliable design.

SUMMARY

An object of the present invention is to provide a web strap buckle with a locking mechanism.

In one exemplary embodiment according the present disclosure, a buckle is provided which has a housing including a cavity with a proximal end and distal end, a first sidewall extending at least partially between the proximal end and the distal end, and a second sidewall, opposite the first sidewall, extending at least partially between the proximal end and the distal end; a detent on at least one of the first sidewall or the second sidewall, and a slide lock positioned in the cavity and slidable between an unlocked position on a proximal side of the detent and a locked position on a distal side of the detent. The housing and/or the slide lock may be molded plastic.

In some embodiments, the slide lock has a body with a distal edge, a proximal edge, and a tab extending upward from the body. The tab may include at least one detent engagement member, such as a flexible member with a protrusion. The slide lock may be symmetrical about the tab. In some embodiments, the body of the slide lock includes side surfaces extending from the proximal edge to the distal edge and at least one protrusion on each of the side surfaces, wherein each of the first and second sidewalls of the housing include slots in which the at least one protrusion is slidably engaged.

The detent may include a first detent on the first sidewall and a second detent opposite the first detent on the second sidewall. The housing may further include a substantially vertical slot extending through the housing proximal to the cavity, e.g., for receiving a web strap.

In some embodiments, a first web strap is provided extending around the slide lock, the first web strap being selectively pinched between the distal edge of the slide lock and the distal end of the cavity. A second web strap may be secured to a proximal portion of the housing through the slot.

The body of the slide lock has side surfaces extending from the proximal edge to the distal edge. In some embodiments, each side surface has an elongated engagement member configured to engage in respective slots in the sidewalls of the housing.

In some embodiments, a distance between the first sidewall and the second sidewall distal to the detent is the same as a distance between the first sidewall and the second sidewall proximal to the detent. In other embodiments, a maximum distance between the first sidewall and the second sidewall distal to the detent is less than a maximum distance between the first sidewall and the second sidewall proximal to the detent. In some embodiments, an average distance between the first sidewall and the second sidewall distal to the detent is less than an average distance between the first sidewall and the second sidewall proximal to the detent.

Further provided is a buckle including a housing including a cavity having a proximal end and distal end, a first sidewall extending at least partially between the proximal end and the distal end, and a second sidewall, opposite the first sidewall, extending at least partially between the proximal end and the distal end, a first detent on the first sidewall, a second detent on the second sidewall, opposite the first detent, and a slide lock positioned in the cavity, the slide lock having a body with a tab extending upward from the body, the slide lock being slidable between an unlocked position on a proximal side of the first and second detents and a locked position on a distal side of the first and second detents. In some embodiments, a maximum distance between the first and second sidewalls distal to the first and second detents is less than a maximum distance between the first and second sidewalls proximal to the first and second detents.

Also provided is a method of selectively securing a web strap, including steps of feeding the web strap into a buckle, the buckle including a housing with a cavity having a proximal end and distal end, a first sidewall extending at least partially between the proximal end and the distal end, and a second sidewall, opposite the first sidewall, extending at least partially between the proximal end and the distal end, a detent on at least one of the first sidewall or the second side, and a slide lock positioned in the cavity and slidable between an unlocked position on a proximal side of the detent and a locked position on a distal side of the detent; wrapping the web strap around the slide lock in the cavity with a portion of the web strap extending between a distal edge of the slide lock and the distal end of the cavity; and sliding the slide lock towards the distal end of the cavity and past the detent, thereby pinching the portion of the web strap between the distal edge of the slide lock and the distal end of the cavity.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Figure 1:
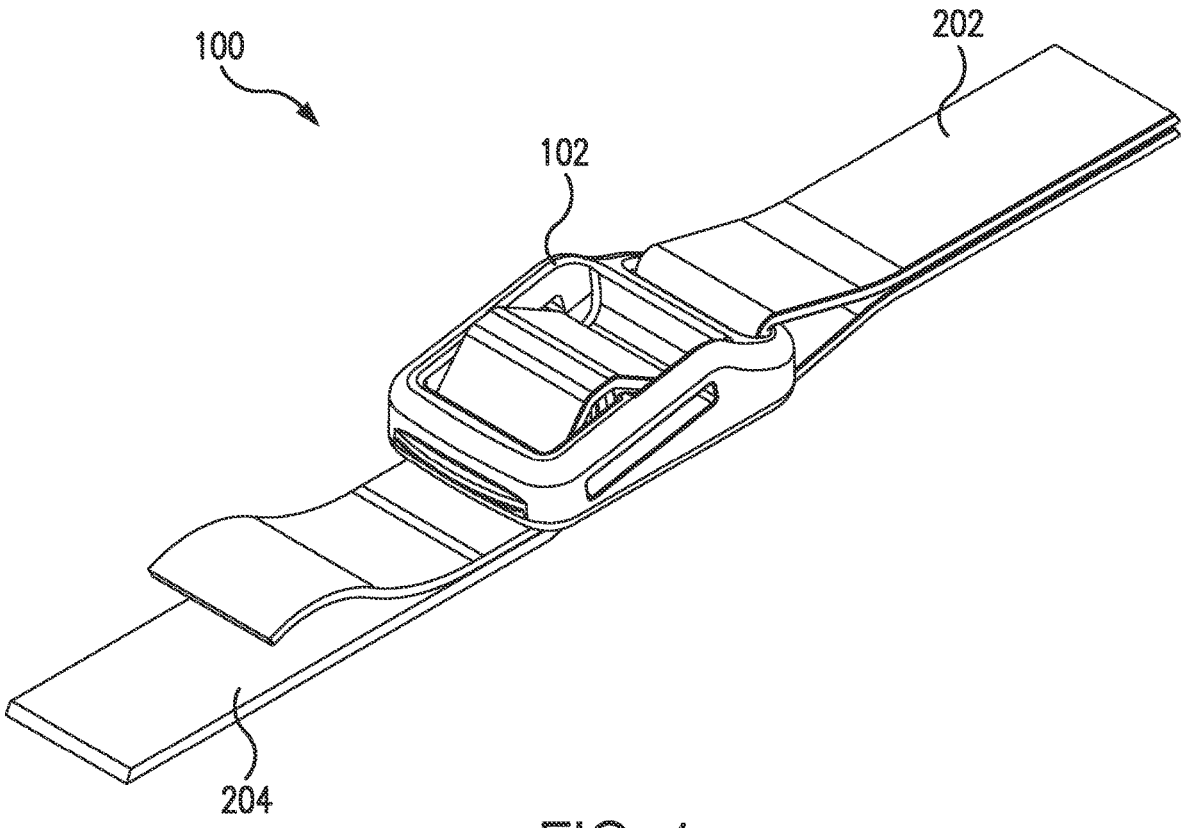
FIG. 1 is a perspective view of a web strap assembly including a buckle according to an exemplary embodiment of the present disclosure.

FIG. 1 is a perspective view of a web strap assembly according to an exemplary embodiment of the present disclosure. The web strap assembly includes a buckle 100, a first web strap 202 secured to a proximal end of the buckle 100, and a second web strap 204 removably secured to a distal end of the buckle 100.

Figure 2:
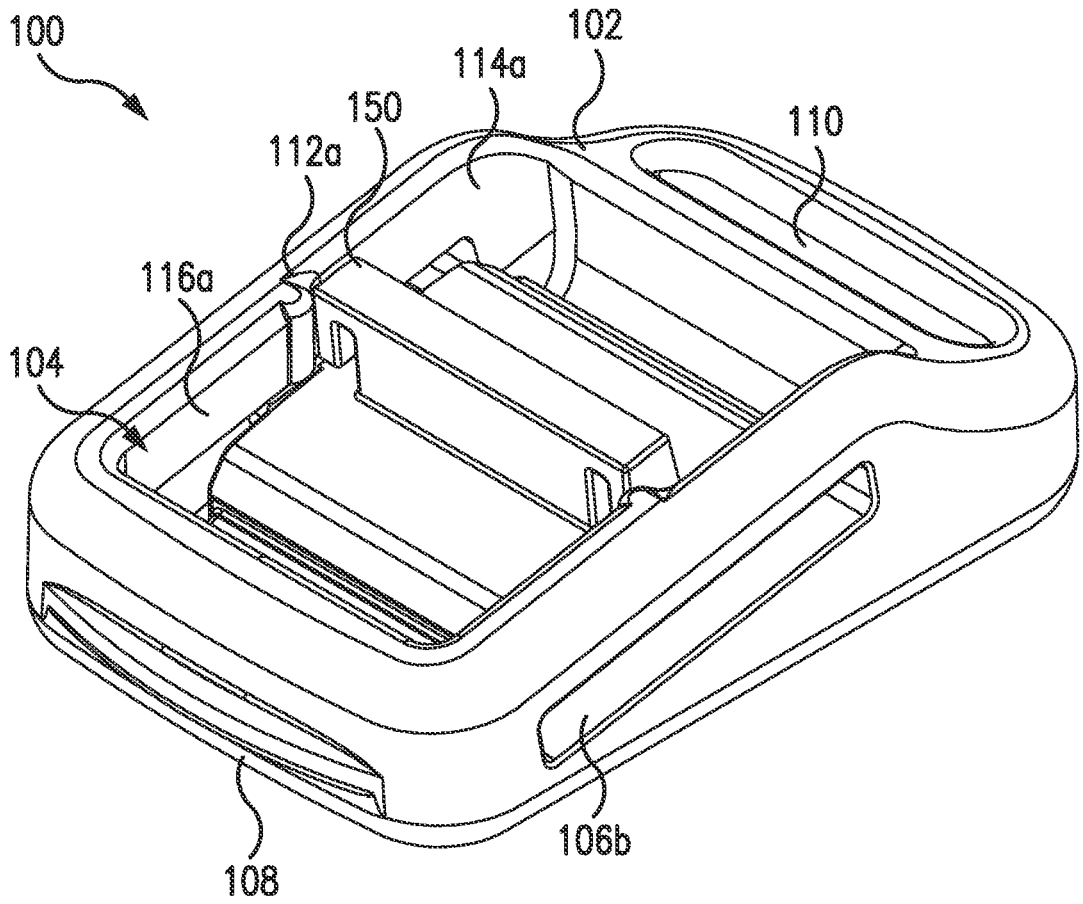
FIG. 2 is a perspective view of a buckle according to an exemplary embodiment of the present disclosure.

FIG. 2 is a perspective view of the buckle 100 according to an exemplary embodiment of the present disclosure. The buckle 100 includes a housing 102 with a distal end 108, a proximal end with a substantially vertical slot 110, and a cavity 104. The housing 102 may have exterior ribs on the distal end 108 and proximal end to increase strength.

In the exemplary embodiment, the cavity 104 extends through the housing 102 defining an at least partially open top and an at least partially open bottom. The cavity 104 has first and second sidewalls opposing one another. Each sidewall has a proximal sidewall portion 114*a*, 114*b* and a distal sidewall portion 116*a*, 116*b* separated by a detent 112*a*, 112*b*. In the exemplary embodiment, each of the first and second sidewalls also has an elongated slot 106*a*, 106*b*, e.g., below the detents 112*a*, 112*b*. The slots 106*a*, 106*b* may slope downward towards a distal end of the cavity 104 and/or buckle 100.

Figure 3:
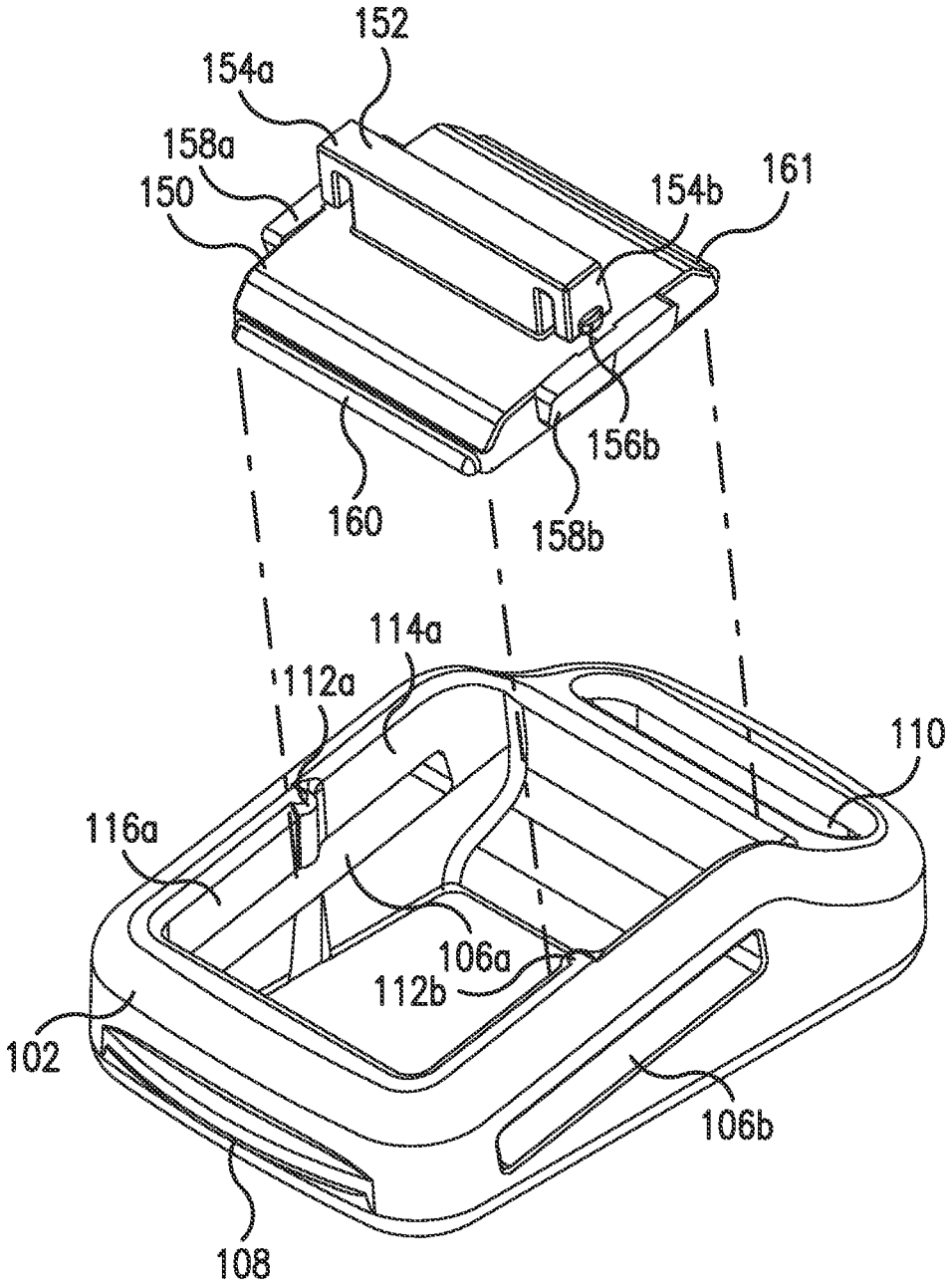
FIG. 3 is an exploded view of the buckle shown in FIG. 2.

A slide lock 150 is removably and slidably positioned in the cavity 104 of the housing 102. FIG. 3 is an exploded view of the buckle 100 shown in FIG. 2 with the slide lock 150 removed. The slide lock 150 is comprised of a body with a distal edge 160 and a proximal edge 161. A tab 152 extends upward from the body of the slide lock 150. The tab 152 allows for selective actuation of the slide lock 150 with a user's thumb or finger between a proximal unlocked position and a distal locked position. The slide lock 150 may be symmetrical about the tab 152, which simplifies installation of the slide lock 150 and assembly of the buckle 100.

The slide lock 150 has detent engagement members 154*a*,154*b* configured to engage with the sidewalls of the cavity 104. In the exemplary embodiment, the engagement members 154*a*, 154*b* are comprised of flexible fingers on opposing sides of the tab 152, each having a protrusion 156*a*, 156*b*. The engagement members 154*a*, 154*b* are flexible or compressible to allow for the slide lock 150 to pass the detents 112*a*, 112*b*.

The slide lock 150 further includes elongated engagement members 158*a*, 158*b* on opposite sides surfaces of the body of the slide lock 150. The engagement members 158*a*, 158*b* engage into the slots 106*a*, 106*b* in the housing 102. The engagement members 158*a*, 158*b* are shaped to facilitate installation in the cavity 104, such as by having a ramp-like cross section with a reduced thickness towards the bottom of the engagement members 158*a*, 158*b*. During installation, the slide lock 150 may be pressed downward into the cavity 104, with engagement members 158*a*, 158*b* proximal to the detents 112*a*, 112*b*, until the engagement members 158*a*, 158*b* engage into respective slots 106*a*, 106*b*.

The housing 102, the slide lock 150, or both may be comprised of molded plastic. In the exemplary embodiment, the entire buckle 100 is molded plastic, such as injection molded Delrin plastic. The buckle 100 according to the present disclosure may be made in different sizes to accommodate different web straps. By way of example, and without limitation, the housing 102 may be approximately 2.4 in. in length, approximately 0.7 in. in height, and approximately 1.5 in. in width when accommodating a one-inch-wide web strap.

Figure 4A:
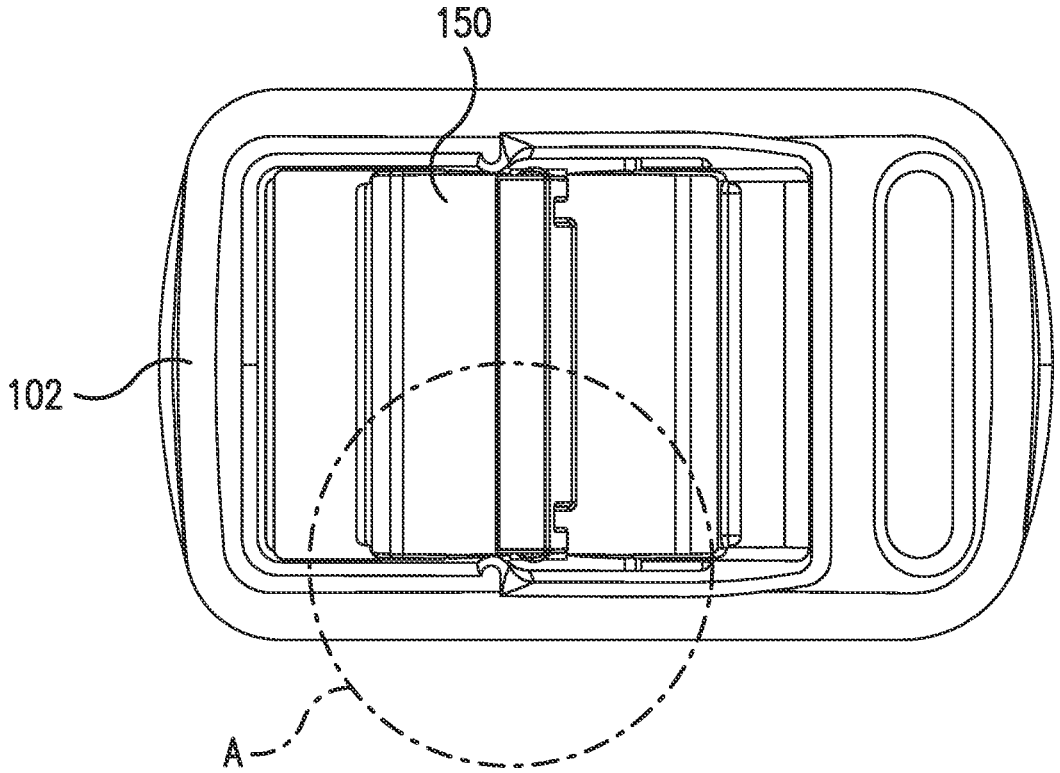
FIG. 4A is a top view of the buckle shown in FIG. 2.
Figure 4B:
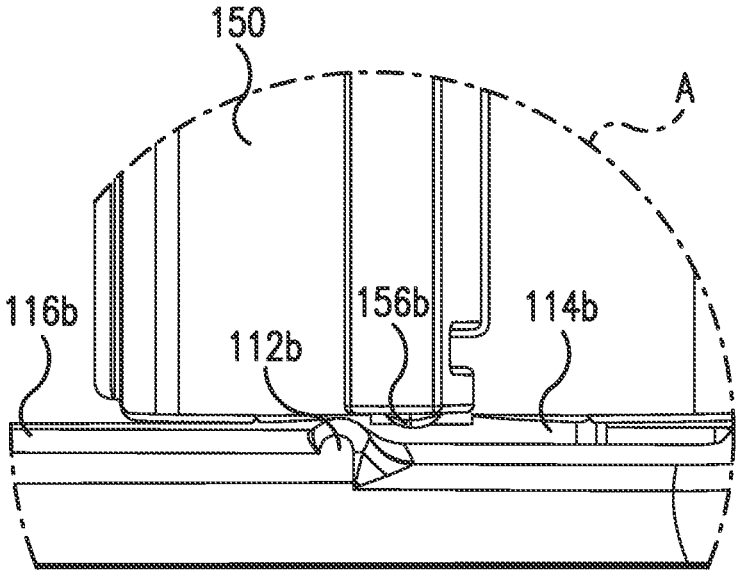
FIG. 4B is a detail view A of the buckle shown in FIG. 4A.

FIG. 4A is a top view of the buckle shown in FIG. 2. FIG. 4B is a detail view A of the buckle shown in FIG. 4A. In the exemplary embodiment, at least a portion of the cavity 104 is wider proximal to the detents 112*a*, 112*b* than it is distal to the detents 112*a*, 112*b*. This allows the slide lock 150 to slide back and forth more easily with its protrusions 156*a*,

156*b* behind the detents 112*a*, 112*b*, and also facilities installing the slide lock 150 in the cavity 104. When the slide lock 150 is pressed forward in the cavity 104 of the buckle 100, the protrusions 156*a*, 156*b* slide over and/or past the detents 112*a*,112*b*. In the forward position, the protrusion 156*a*, 156*b* are pressed against the sidewalls 116*a*, 116*b* and the engagement members 154*a*, 154*b* may be at least partially flexed or compressed.

In some embodiments, a first distance between distal sidewalls 116*a*, 116*b* is equal to a second distance between proximal sidewalls 114*a*,114*b*. In other embodiments, the first distance between distal sidewalls 116*a*, 116*b* and the second distance between proximal sidewalls 114*a*, 114*b* are each constant with the first distance being less than the second. In other embodiments, the distances between the sidewalls are not constant though a maximum or average distance between the proximal sidewalls 114*a*,114*b* is greater than a maximum or average distance between the distal sidewalls 116*a*, 116*b*. Alternatively or in combination, the distal sidewalls 116*a*, 116*b* may be drafted such that they slope outward towards the top of the cavity 104 to further enable the slide lock 150 to easily snap into the cavity 104.

Figure 5:
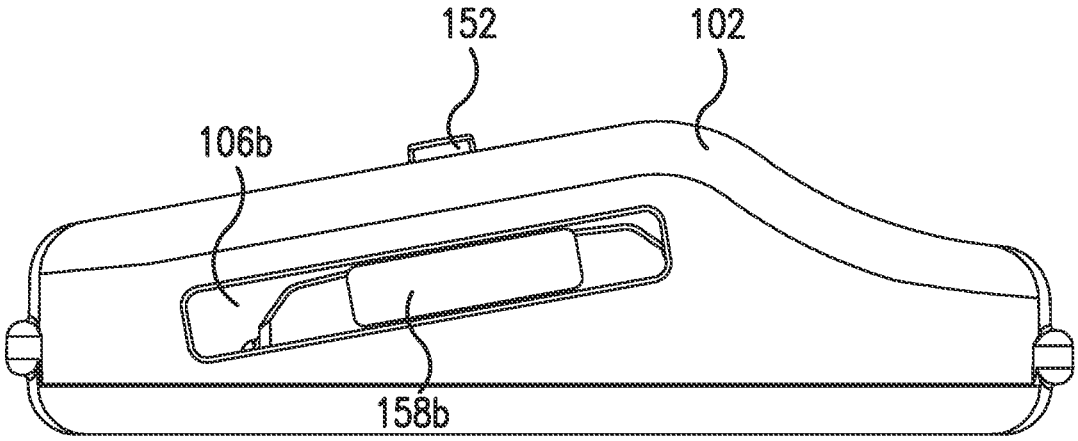
FIG. 5 is a side view of the buckle shown in FIG. 2.

FIG. 5 is a side view of the buckle 100 illustrating the engagement member 158*b* in the slot 106*b*. As shown in FIG. 5, the slots 106*a*, 106*b* have a length greater than a length of the engagement members 158*a*, 158*b* to allow the engagement members 158*a*, 158*b* to slide within the slots 106*a*, 106*b*. In some embodiments, the length of the slots 106,106*b* is at least 50% greater than the length of the engagement members 158*a*, 158*b*. In some embodiments, the length of the slots 106,106*b* is at least two times greater than the length of the engagement members 158*a*, 158*b*.

Figure 6A:
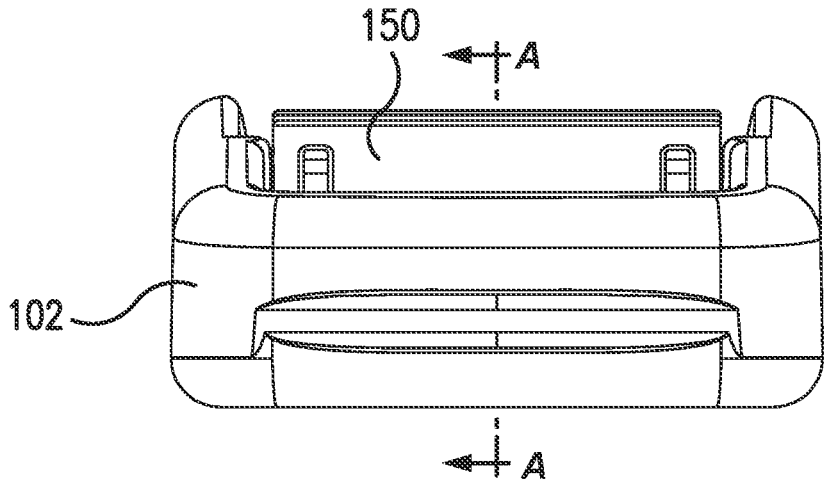
FIG. 6A is an end view of the buckle shown in FIG. 2.
Figure 6B:
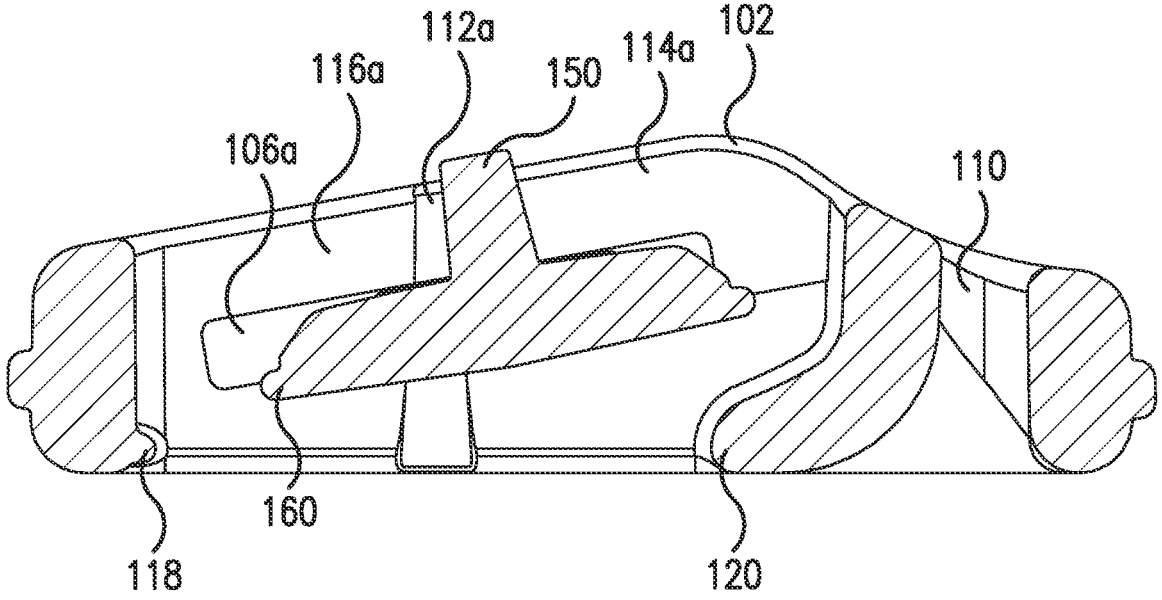
FIG. 6B is a cutaway view A of the buckle shown in FIG. 6A.
Figure 7A:
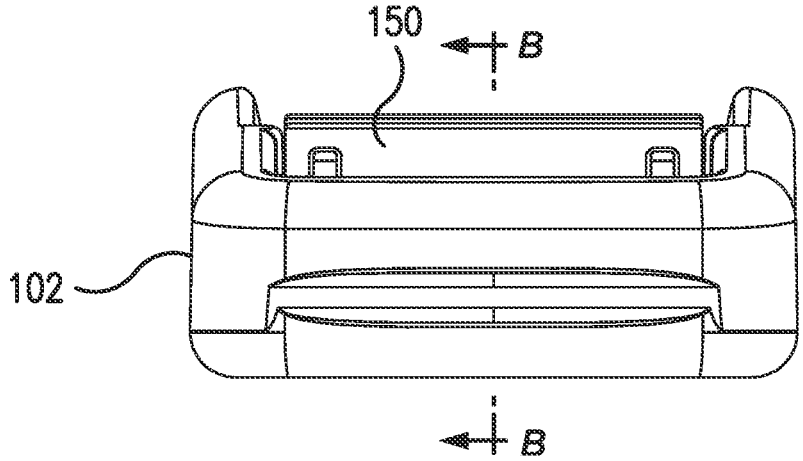
FIG. 7A is an end view of the buckle shown in FIG. 2.
Figure 7B:
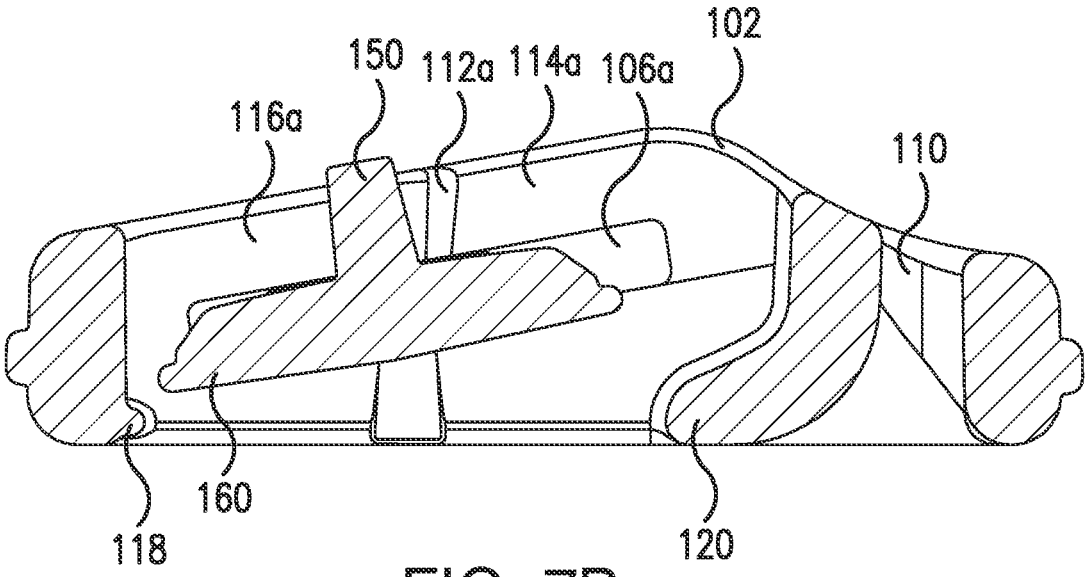
FIG. 7B is a side cutaway view B of the buckle shown in FIG. 7A.

FIG. 6A is an end view of the buckle shown in FIG. 2. FIG. 6B is a cutaway view A of the buckle 100 shown in FIG. 6A. FIGS. 6A-6B show the buckle 100 with the slide lock 150 in a proximal position, behind the detents 112*a*, 112*b*. FIG. 7A is an end view of the buckle 100. FIG. 7B is a side cutaway view B of the buckle 100 shown in FIG. 7A. In FIGS. 7A-7B, the slide lock 150 in a distal position, in front of the detents 112*a*, 112*b*. When the slide lock 150 is pushed forward into the distal position, the distal edge 160 of the slide lock 150 approaches a rib 118 on an inside of the cavity 104.

FIGS. 8A to 8D are side cutaway views of the web strap assembly shown in FIG. 1. FIG. 8E is a detail view A of the web strap assembly shown in FIG. 8D.

Figure 8A:
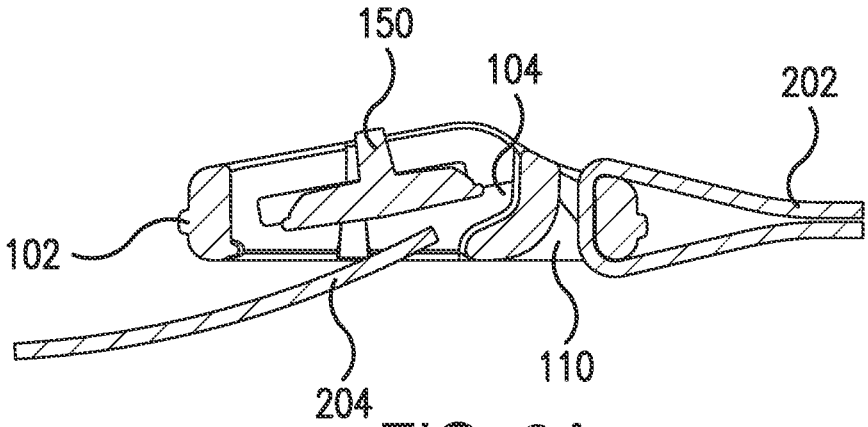
FIGS. 8A to 8D are side cutaway views of the web strap assembly shown in FIG. 1.
Figure 8B:
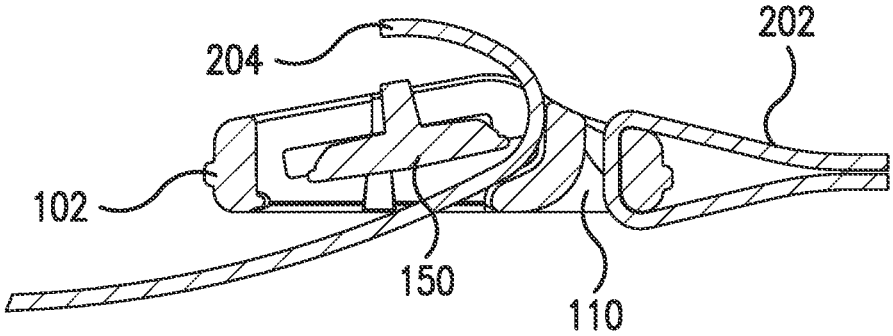
Figure 8C:
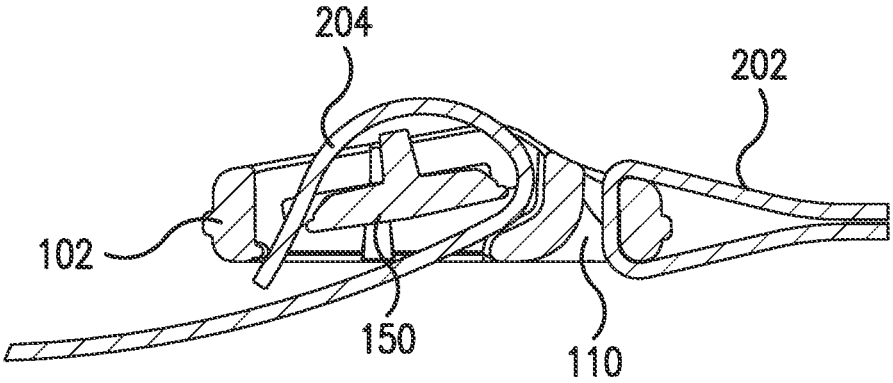

As shown in FIGS. 8A-8C, a web strap 204 is fed into the housing 102 of the buckle 100 while the slide lock 150 is in its unlocked or proximal position. The web strap 204 is fed behind the proximal edge of the slide lock 150 adjacent to a curved proximal wall of the cavity 104, over the top of the slide lock 150, and in front of the distal edge 160 of the slide lock 150 adjacent to a distal wall of the cavity 104. The strap 204 can be pulled tight and/or to a desired length.

Figure 8D:
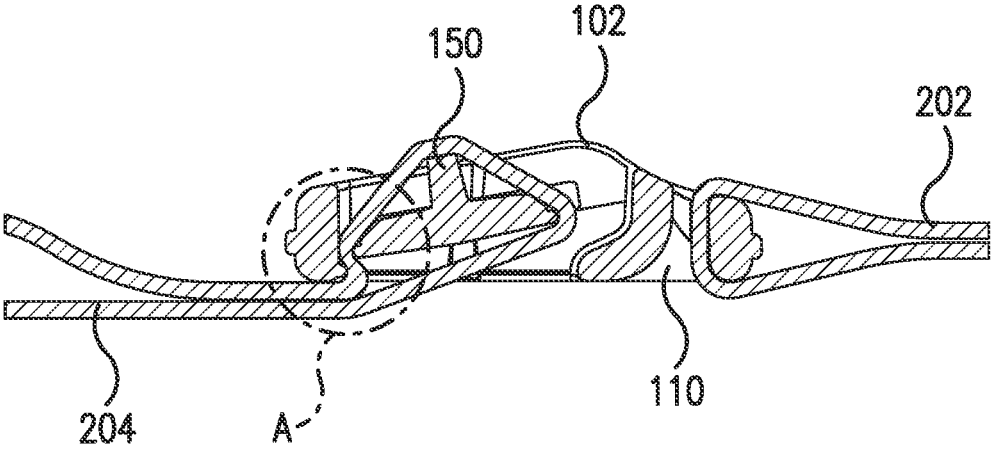
Figure 8E:
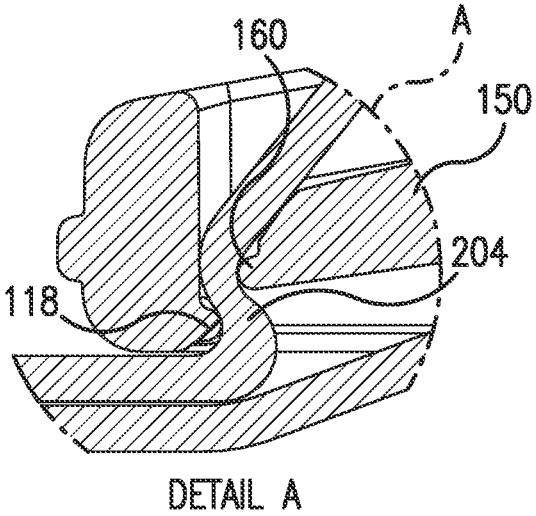
FIG. 8E is a detail view A of the web strap assembly shown in FIG. 8D.

As shown in FIGS. 8D-8E, the slide lock 150 is then selectively moved into its locked or distal position. The web strap 204 is pinched between the slide lock 150 and the housing 102 of the buckle 100. The distal edge 106 and rib 118 cause the web strap to double back and/or form an "S" curve when engaging in the buckle 100. The slide lock 150 can be moved to the unlocked or proximal position to adjust, reposition, or release the web strap 204.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A buckle, comprising:

a housing including a cavity having a proximal end and distal end, a first sidewall extending at least partially between the proximal end and the distal end, and a second sidewall, opposite to and facing the first sidewall, extending at least partially between the proximal end and the distal end;

a detent on at least one of the first sidewall or the second sidewall extending into the cavity toward an opposite one of the first sidewall or the second sidewall; and a slide lock positioned in the cavity and slidable between an unlocked position on a proximal side of the detent and a locked position on a distal side of the detent, the slide lock having at least one detent engagement member configured to slide over the detent and press against at least one of the first sidewall or the second sidewall in the locked position.

2. The buckle of claim 1, wherein the slide lock comprises a body having distal edge and a proximal edge, and a tab for selectively positioning the slide lock, extending upward from the body between the first sidewall and the second sidewall of the cavity, wherein the at least one detent engagement member is on the tab.

3. The buckle of claim 2, wherein the slide lock is symmetrical about the tab.

4. The buckle of claim 2, wherein the at least one detent engagement member is a flexible member with a protrusion.

5. The buckle of claim 2, further comprising:

a first web strap extending around the slide lock, the first web strap being selectively pinched between the distal edge of the slide lock and the distal end of the cavity.

6. The buckle of claim 2, wherein the body of the slide lock includes two opposing side surfaces extending from the proximal edge to the distal edge and an elongated engagement member on each of the side surfaces, each of the elongated engagement members having an angled distal surface such that a width of the body of the slide lock between the distal surfaces of the respective elongated engagement members decreases towards a bottom of the body of the slide lock to facilitate installation into the cavity, wherein each of the first and second sidewalls includes a slot in which a respective one of one elongated engagement members is slidably engaged.

7. The buckle of claim 6, wherein the detent is on at least one of the first sidewall or the second sidewall above the respective slot.

8. The buckle of claim 6, wherein each of the slots slopes downward towards the distal end of the cavity.

9. The buckle of claim 1, wherein the detent includes a first detent on the first sidewall and a second detent opposite the first detent on the second sidewall.

10. The buckle of claim 1, wherein the housing includes a slot extending through the housing proximal to the cavity for receiving a web strap.

11. The buckle of claim 1, wherein the distal end of the cavity includes a rib extending into the cavity.

12. The buckle of claim 11, wherein the slide lock comprises a body having distal edge and a proximal edge, wherein the rib is below the distal edge of the body of the slide lock when the slide lock is in the locked position.

13. The buckle of claim 1, wherein the housing and the slide lock are comprised of molded plastic.

14. The buckle of claim 1, wherein a distance between the first sidewall and the second sidewall distal to the detent is equal to a distance between the first sidewall and the second sidewall proximal to the detent.

15. The buckle of claim 1, wherein an average distance between the first sidewall and the second sidewall distal to the detent is less than an average distance between the first sidewall and the second sidewall proximal to the detent.

16. The buckle of claim 1, wherein the cavity has a top opening larger than a bottom opening of the cavity.

17. A buckle, comprising:

a housing including a cavity having a proximal end and distal end, a first sidewall extending at least partially between the proximal end and the distal end, and a second sidewall, opposite and facing the first sidewall, extending at least partially between the proximal end and the distal end;

a first detent on the first sidewall;

a second detent on the second sidewall, opposite to and extending into the cavity toward the first detent; and a slide lock positioned in the cavity, the slide lock having a body with a tab extending upward from the body between the first sidewall and the second sidewall of the cavity, the slide lock being slidable between an unlocked position on a proximal side of the first and second detents and a locked position on a distal side of the first and second detents, wherein the slide lock is fixed in position when in the locked position on a distal side of the detent.

18. A method of selectively securing a web strap, comprising steps of:

feeding the web strap into a buckle, the buckle including a housing with a cavity having a proximal end and distal end, a first sidewall extending at least partially between the proximal end and the distal end, and a second sidewall, opposite to and facing the first sidewall, extending at least partially between the proximal end and the distal end, a detent on at least one of the first sidewall or the second sidewall extending into the cavity toward an opposite one of the first sidewall or the second sidewall, and a slide lock positioned in the cavity and slidable between an unlocked position on a proximal side of the detent and a locked position on a distal side of the detent;

wrapping the web strap around the slide lock in the cavity with a portion of the web strap extending between a distal edge of the slide lock and the distal end of the cavity; and sliding the slide lock towards the distal end of the cavity and past the detent, thereby pinching the portion of the web strap between the distal edge of the slide lock and the distal end of the cavity, wherein the slide lock has at least one detent engagement member that slides over the detent and presses against at least one of the first sidewall or the second sidewall in the locked position.

19. The buckle of claim 17, wherein the body of the slide lock includes two opposing side surfaces and an elongated engagement member on each of the side surfaces, each of the elongated engagement members having an angled distal surface such that a width of the body of the slide lock between the distal surfaces of the respective elongated engagement members decreases towards a bottom of the body of the slide lock to facilitate installation into the cavity, wherein each of the first and second sidewalls includes a slot in which a respective one of one elongated engagement members is slidably engaged.

20. The buckle of claim 1, wherein the slide lock is fixed in position when in the locked position on a distal side of the detent.

* * * * *